US005411634A

United States Patent [19]

Henricson et al.

[11] Patent Number: 5,411,634

[45] Date of Patent: May 2, 1995

[54] MEDIUM CONSISTENCY OZONE BLEACHING

[75] Inventors: Kaj Henricson, Helsinki, Finland; Joseph Phillips, Glens Falls, N.Y.; Brian F. Greenwood, Glens Falls, N.Y.; Erwin D. Funk, Glens Falls, N.Y.; Stephen J. Dunne, Glens Falls, N.Y.

[73] Assignee: Kamyr, Inc., Glens Falls, N.Y.

[21] Appl. No.: 710,439

[22] Filed: Jun. 7, 1991

Related U.S. Application Data

[63] Continuation-in-part of Ser. No. 693,287, Apr. 30, 1991.

[51] Int. Cl.[6] ..... D21C 9/153

[52] U.S. Cl. ..... 162/52; 162/65

[58] Field of Search ..... 162/65, 52, 246

[56] References Cited

U.S. PATENT DOCUMENTS

| | | | |
|---|---|---|---|
| 4,372,812 | 2/1983 | Phillips et al. | 162/40 |
| 4,902,381 | 2/1990 | Meredith | 162/88 |
| 5,034,095 | 7/1991 | Kido et al. | 162/65 |

FOREIGN PATENT DOCUMENTS

| | | |
|---|---|---|
| 0397308 | 11/1990 | European Pat. Off. . |
| 0426652 | 5/1991 | European Pat. Off. . |

OTHER PUBLICATIONS

*Paper and Timber*, "Effect of pulp consistency and pH in ozone bleaching", Lindholm, Feb. 1989, pp. 145, 147, 149, 150, 152, 154.

*Paper and Timber* "Effect of heterogeneity in pulp bleaching with ozone" Lindholm, Apr. 1986, pp. 283, 284, 286, 287, 288, 290.

"Ozone Bleaching Medium Consistency Technology and Mill Experience", Sixta et al, pp. 1–13, two drawing figures (admitted prior art).

"Medium consistency ozone bleaching", Laxen et al, 27 Mar. 1991, pp. 1–10, five drawing figures (admitted prior art).

*Primary Examiner*—Steve Alvo

*Attorney, Agent, or Firm*—Nixon & Vanderhye

[57] ABSTRACT

In a method of bleaching medium consistency pulp with ozone using a mixer, ozone containing gas and about 6–15% consistency pulp are fed to the mixer, and then discharged in a first, preferably vertical, path. The mixture of pulp and ozone moves in a first part of the vertical path a time period of about 1–5 seconds at a velocity of about 1–5 m/s so that the gas and pulp do not separate during movement in this first part, and the vast majority of the pulp brightening reaction between the ozone and pulp takes place. This is preferably accomplished by passing the mixture upwardly in a small diameter conduit having a height of about 3–20 meters. Then the velocity of the pulp is slowed while still moving in the first path, preferably by feeding it directly to a much larger diameter (e. g. 1.5–10 times) conduit, so the height of the unit may be kept under 100 feet. The pulp flows in the large diameter conduit for about 0.5–5 minutes so that residual reactions take place.

16 Claims, 1 Drawing Sheet

MEDIUM CONSISTENCY OZONE BLEACHING

RELATED APPLICATIONS

This application is a continuation in part of application Ser. No. 07/693,287 filed Apr. 30, 1991, the disclosure of which is hereby incorporated by reference herein.

BACKGROUND AND SUMMARY OF THE INVENTION

In the related application Ser. No. 07/693,287, and in copending application Ser. No. 07/498,205 filed Mar. 23, 1990, ozone bleaching of medium consistency comminuted cellulosic fibrous material slurry (paper pulp) is effected. While the systems illustrated therein are effective, it has now been recognized that the ozone-pulp reaction is even quicker than originally presumed, and under some circumstances a more simplified apparatus may be utilized to take advantage of this quick reaction time.

It has been found that the actual time in which the vast majority (e.g. over 80–90%) of the pulp brightness enhancing reaction of ozone with medium consistency pulp takes place is on the order of about 1–5 seconds. Therefore, as long as the pulp can be maintained intimately mixed with the ozone during this time period (without separation of the gas), for the rest of the reaction period pulp configuration is of little importance. According to the present invention the pulp is maintained in intimate contact with the ozone containing gas during this critical, brightness-enhancing, first time period of about 2–5 seconds by passing the pulp and ozone together at a relatively high velocity, e.g. over about 1 m/s, preferably about 2–5 m/s. Then the pulp velocity is slowed since the pulp flows into a larger diameter conduit, so that the residual products can continue to react, preferably for a second time period of about 0.5–5 minutes, but yet the height of the unit can be kept less than about 100 feet, and avoids turns. The movement of the pulp during these first and second time periods is preferably in a first, continuous, generally vertical, path.

According to one aspect of the present invention, a method of ozone bleaching paper pulp having a consistency of about 6–15% throughout treatment, using a mixer, is provided. The method comprises the steps of continuously and substantially sequentially: (a) Feeding ozone in a carrier gas, under a pressure substantially greater than 1 bar, and paper pulp having a consistency of about 6–15%, to a mixer. (b) Effecting uniform and intimate mixing of the pulp and ozone in the mixer. (c) Passing the intimate mixture of ozone and pulp from the mixer in a first, substantially vertical, path at a first velocity of about 1 m/s or greater (preferably about 2–5 m/s) for a during a first time period of about 1–5 seconds, so that the gas and pulp do not separate during movement at the first velocity during the first time period, and the vast majority of the pulp brightening reaction between ozone and pulp takes place. And, (d) reducing the velocity of the pulp and gas mixture while it continues to move in first path for a second time period, so that reaction can move toward completion, by passing the pulp into a larger cross-sectional area portion of the first path. Step (c) is preferably practiced in a small diameter (e.g. 0.5–2 feet) conduit, while step (d) is a larger diameter conduit (e.g. 1.5–10 times larger), with a transition between them. The amount of ozone in the ozone containing gas led to the mixer is about 3–12%, and the reaction conditions are typical, e.g. about 25–90 degrees C. Step (d) is practiced for about 0.5–5 minutes, and then the pulp is moved in a second path, distinctly different from the first path.

According to another aspect of the present invention, a method is provided in which steps (a) and (b) are the same, and comprising the further steps of: (c) passing the intimate mixture of ozone and pulp from the mixer in a first, substantially vertical, path at a first velocity and for a first time period such that the gas and pulp do not separate during movement at the first velocity, and the vast majority of the pulp brightening reaction between ozone and pulp takes place during the first time period, by moving the pulp upwardly in a small diameter conduit; and (d) slowing down the velocity of the pulp and gas mixture while it continues to move in said first path by moving the pulp upwardly into a large diameter conduit above and in open communication with the small diameter conduit.

According to yet another aspect of the present invention, steps (a) and (b) are the same, and then the following steps are practiced: (c) passing the intimate mixture of ozone and pulp from the mixer in a first path at a first velocity of about 1–5 m/s for a first time period of about 1–5 seconds, so that the gas and pulp do not separate during movement at the first velocity during the first time period, and the vast majority of the brightness increasing reaction between ozone and pulp takes place; (d) slowing down the velocity of the pulp and gas mixture while it continues to move in said first path for a second time period of about 0.5–5 minutes; and (e) moving the pulp in a second path, distinctly different from the first path.

It is the primary object of the present invention to provide a simple yet effective method for ozone bleaching of medium consistency paper pulp. This and other objects of the invention will become clear from an inspection of the detailed description of the invention, and from the appended claims.

DETAILED DESCRIPTION OF THE DRAWINGS

Figure 1:
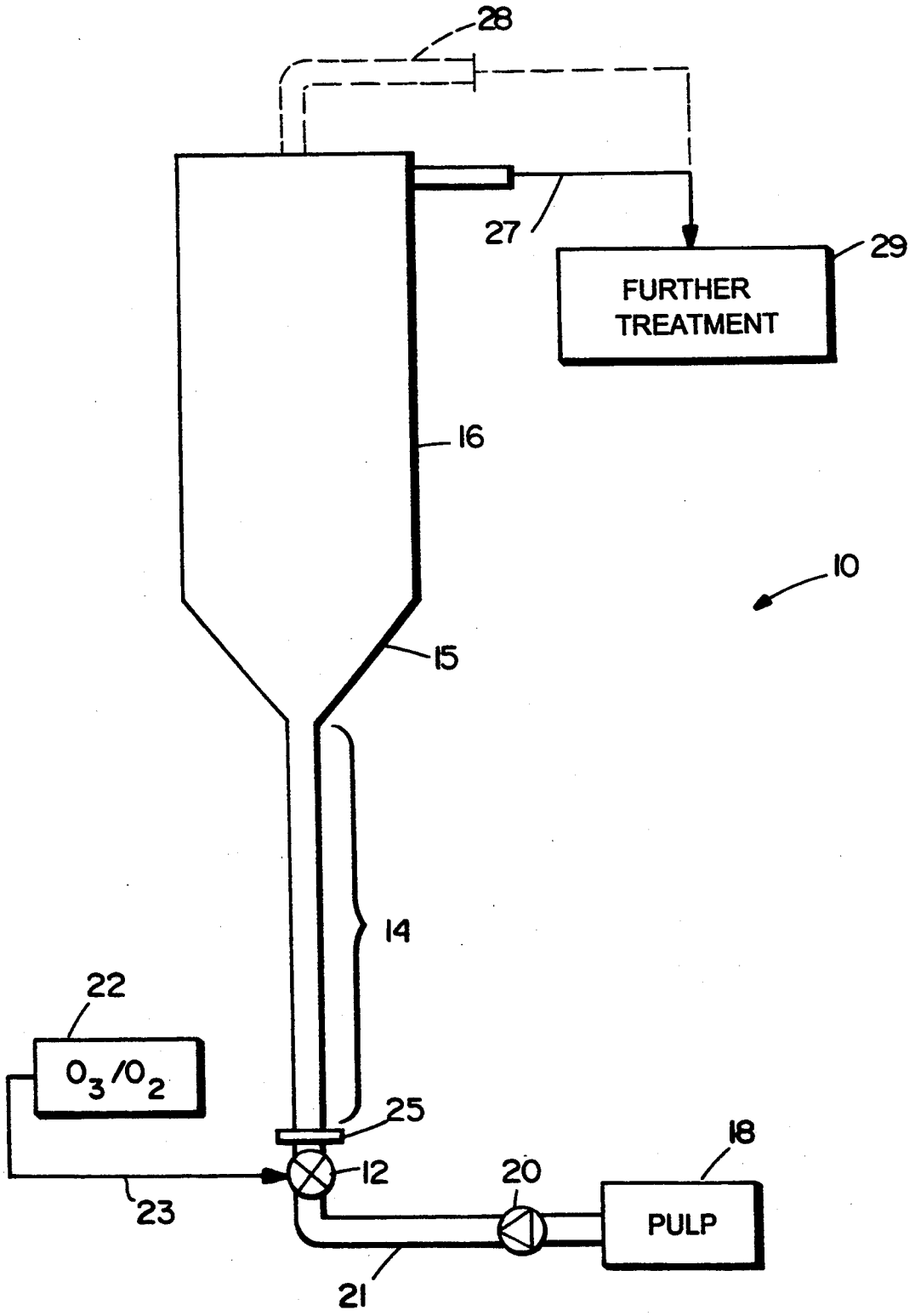
FIG. 1 is a schematic view of exemplary apparatus for practicing the ozone delignification method according to the present invention.

An exemplary apparatus for practicing a method of ozone delignification according to the present invention is illustrated generally by reference numeral 10 in FIG. 1. The apparatus 10 includes as the major components a fluidizing mixer 12, a preferably substantially vertical small diameter (e. g. about 0.5–2 feet) conduit 14 extending upwardly from the mixer 12, and a larger diameter conduit 16 above the conduit 14, which may be connected thereto by transition 15.

Medium consistency (e. g. about 6–15%, preferably about 8–12%) pulp is fed from source 18 by pump 20 to the mixer 12 via conduit 21, while at the same time that ozone containing gas from source 22 is fed into the mixer 12 via conduit 23. The ozone is normally in oxygen (the carrier gas), and typically is about 3–12% of the amount of the gas fed to the mixer 12. The gas is at a pressure substantially above 1 bar, any even up to about 4–20 bar (e. g. 7–20 bar). The mixer 12 preferably is a mixer of the type sold by Kamyr, Inc. of Glens Falls N.Y. under the trademark MC®, which fluidizes the pulp, and similarly the pump 20 preferably is a Kamyr, Inc. MC® pump.

Preferably, the discharge conduit section 25 of the mixer 12 faces upwardly, and the small diameter conduit 14 has approximately the same internal diameter as the section 25. In any event, the properties of the conduit 14 are such—combined with the properties of the pulp and gas mixture from the mixer 12—that the mixture will flow with a high enough velocity in the conduit 12 so that the gas will not separate from the pulp, and the vast majority (e.g. over about 80-90%) of the pulp brightness enhancing reaction takes place during a first time period of about 1-5 seconds. The velocity during this first time period typically is about 1 m/s or above, preferably about 2-5 m/s; and the conduit 14 preferably has a height of about 3-20 meters.

The larger diameter conduit 16 preferably has a diameter of about 1.5-10 times larger than that of the conduit 14, so that the mixture flow velocity therein is reduced compared to that in the conduit 14. The velocity in conduit 16 is typically substantially less than about 1 m/s, although it can be more, depending upon its initial velocity. The pulp is maintained in the conduit 16 about 0.5-5 minutes to allow the residual reactions to take place, but the larger diameter of the conduit 16 allows the height of the unit to be kept under 100 feet. No significant gas-pulp separation is intended to take place in conduit 16.

Treatment in conduits 14, 16 preferably takes place in a first, substantially vertical, path, and at conventional medium consistency pulp ozone bleaching conditions, e.g. about 25-90 degrees C. After completion of the bleaching reaction in conduit 16, the pulp is then moved in a second path, e.g. through conduit 27 (or U-tube like arrangement 28), to a further treatment station 29.

Utilizing the apparatus of FIG. 1, a method of ozone bleaching paper pulp having medium consistency (e.g. of about 6-15%) throughout treatment, using the mixer 12, is provided. The method may comprise the steps of continuously and substantially sequentially:

(a) Feeding ozone in a carrier gas (from 22, in 23), under a pressure substantially greater than 1 bar (and as high as about 4-20 bar, e.g. about 7-20 bar), and paper pulp having a consistency of about 6-15%, to the mixer 12. (b) Effecting uniform and intimate mixing of the pulp (from 18) and ozone (from 22) in the mixer 12. (c) Passing the intimate mixture of ozone and pulp from the mixer in a first, substantially vertical, path (defined by 14, then 16) at a first velocity of about 1 m/s or greater for a first time period of about 1-5 seconds (in conduit 14), so that the gas and pulp do not separate during movement at the first velocity during the first time period, and the vast majority of the pulp-brightening reaction between ozone and pulp takes place. And (d) reducing the velocity of the pulp and gas mixture while it continues to move in first path for a second time period (in conduit 16, preferably about 0.5-5 minutes), the larger cross-sectional area of the part of the flow path in which reaction for the second time period takes place allowing the height of the unit to be minimized. Then the further step (e) of moving the pulp in a second path (27, 28), distinctly different from the first path (14, 16) is practiced, e.g. to a further treatment station 29.

It will thus be seen that according to the present invention, a simple yet effective method is provided for taking advantage of the extremely short time for ozone to react with medium consistency pulp, and maintaining the pulp and ozone containing gas in sure intimate contact only during that time period, preferably by flowing them together at relatively high velocity.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of ozone bleaching paper pulp having a consistency of about 6-15% throughout treatment, using a mixer, comprising the steps of continuously and substantially sequentially:

(a) feeding ozone in a carrier gas, under a pressure substantially greater than 1 bar, and paper pulp having a consistency of about 6-15%, to the mixer;

(b) effecting uniform and intimate mixing of the pulp and ozone in the mixer;

(c) passing the intimate mixture of ozone and pulp from the mixer in a first, substantially vertical, path at a first velocity of about 1 m/s or greater for a first time period of about 1-5 seconds, so that the gas and pulp do not separate during movement at the first velocity during the first time period, and the vast majority of the pulp brightening reaction between ozone and pulp takes place; and (d) reducing the velocity of the pulp and gas mixture while it continues to move in the first path for a second time period, during which time the flow path has a larger cross-sectional area, and the reaction continues to take place.

2. A method as recited in claim 1 wherein step (d) is practiced to maintain the pulp and gas flowing during the second time period for about 0.5-5 minutes; and then comprising the further step (e) of moving the pulp in a second path, distinctly different from the first path.

3. A method as recited in claim 2 wherein step (c) is practiced by moving the pulp upwardly in a small diameter conduit having a height of about 3-20 meters.

4. A method as recited in claim 3 wherein step (d) is practiced by moving the pulp upwardly into a large diameter conduit above and in open communication with the small diameter conduit.

5. A method as recited in claim 4 wherein the mixer has a vertically extending discharge conduit of given diameter, and wherein the small diameter conduit has a diameter approximately the same as the discharge conduit diameter.

6. A method as recited in claim 5 wherein step (d) is further practiced by providing the large diameter conduit with a diameter of about 1.5-10 times the diameter of the small diameter conduit.

7. A method as recited in claim 6 wherein step (d) is further practiced by providing a transition that gradually increases in diameter from the small diameter conduit to the large diameter conduit.

8. A method as recited in claim 1 wherein step (a) is practiced by providing about 3-12% ozone in the carrier gas.

9. A method as recited in claim 1 wherein steps (a)-(d) are practiced while maintaining the pulp consistency at about 8-12% throughout.

10. A method as recited in claim 9 wherein step (d) is practiced to maintain the pulp and gas flowing for a second time period of about 0.5–5 minutes; and then comprising the further step (e) of moving the pulp in a second path, distinctly different from the first path.

11. A method as recited in claim 1 wherein step (c) is practiced by moving the pulp upwardly in a small diameter conduit having a height of about 3–20 meters.

12. A method as recited in claim 1 wherein step (c) is practiced by moving the pulp upwardly in the first path during the first time period at a velocity of about 2–5 m/s.

13. A method of ozone bleaching paper pulp having a medium consistency throughout treatment, using a mixer, comprising the steps of continuously and substantially sequentially:

(a) feeding ozone in a carrier gas, under a pressure substantially greater than 1 bar, and medium consistency paper pulp, to the mixer;

(b) effecting uniform and intimate mixing of the pulp and ozone in the mixer;

(c) passing the intimate mixture of ozone and pulp from the mixer in a first path at a first velocity of about 1–5 m/s for a first time period of about 1–5 seconds, so that the gas and pulp do not separate during movement at the first velocity during the first time period, and the vast majority of the brightness increasing reaction between ozone and pulp takes place;

(d) slowing down the velocity of the pulp and gas mixture while it continues to move in said first path and have residual reactions for a second time period of about 0.5–5 minutes; and then (e) moving the pulp in a second path, distinctly different from the first path.

14. A method as recited in claim 13 wherein step (c) is practiced by moving the pulp mixture at a velocity of about 2–5 m/s during the first time period.

15. A method as recited in claim 14 wherein steps (a)-(d) are practiced to maintain the consistency of the pulp about 8–12% during the entire treatment.

16. A method as recited in claim 13 wherein steps (a)-(d) are practiced to maintain the consistency of the pulp about 8–12% during the entire treatment, and step (d) is practiced by passing the pulp mixture into a larger diameter conduit having a diameter about 1.5–10 times that of a conduit through which the pulp mixture passes in the practice of step (c).

* * * * *